US006516834B2

(12) United States Patent
Verhulst et al.

(10) Patent No.: US 6,516,834 B2
(45) Date of Patent: Feb. 11, 2003

(54) REED WITH BRACING ARRANGEMENT

(75) Inventors: Joseph Verhulst, Zillebeke (BE); Jozef Peeters, Ieper (BE)

(73) Assignee: Picanol NV, Ieper (BE)

( * ) Notice: Subject to any disclaimer, the term of this patent is extended or adjusted under 35 U.S.C. 154(b) by 0 days.

(21) Appl. No.: 09/984,123

(22) Filed: Oct. 26, 2001

(65) Prior Publication Data

US 2002/0043291 A1 Apr. 18, 2002

Related U.S. Application Data

(63) Continuation of application No. 09/701,580, filed as application No. PCT/EP99/03686 on May 28, 1999, now Pat. No. 6,318,412.

(30) Foreign Application Priority Data

Jun. 10, 1998 (BE) ..... 9800448

(51) Int. Cl.[7] ..... D03D 49/62; D03D 49/60

(52) U.S. Cl. ..... 139/192

(58) Field of Search ..... 139/192

(56) References Cited

U.S. PATENT DOCUMENTS

| | | | | | |
|---|---|---|---|---|---|
| 46,381 | A | | 2/1865 | Nichols | |
| 1,682,334 | A | * | 8/1928 | Hauser | 139/192 |
| 2,717,007 | A | | 9/1955 | Battles | |
| 2,775,985 | A | * | 1/1957 | Schmidt | 139/192 |
| 4,015,640 | A | | 4/1977 | Oesterle | |
| 6,039,087 | A | * | 3/2000 | Thompson, III et al. | 139/192 |
| 6,318,412 | B1 | * | 11/2001 | Verhulst et al. | 139/192 |

* cited by examiner

*Primary Examiner*—Andy Falik
(74) *Attorney, Agent, or Firm*—Bacon & Thomas, PLLC

(57) ABSTRACT

A loom reed including upper and lower bars which support reed dents and extend along the length of the reed is provided with a connecting device for connecting a brace to the upper bar to restrict longitudinal movement of the reed during loom operation.

29 Claims, 4 Drawing Sheets

REED WITH BRACING ARRANGEMENT

CROSS REFERENCE TO RELATED APPLICATIONS

This application is a continuation of U.S. patent application Ser. No. 09/701,580, filed Dec. 11, 2000 now U.S. Pat. No. 6,318,412, which is a national stage filing under 35 U.S.C. 371 of PCT/EP99/03686 filed May 28, 1999 designating the United States and Published by the International Bureau in a language other than English on Dec. 16, 1999.

BACKGROUND OF THE INVENTION

1. Field of the Invention

The invention relates to a device for securing a weaving reed, hereafter reed, to the batten beam of a weaving machine, the reed comprising an upper profiled bar, in particular an upper U-channel, a lower profiled bar, in particular a lower U-channel, to be secured to the batten beam, and reed dents mounted in-between the channels.

2. Description of the Related Art

It is known to affix the lower U-channel profiled bar of a reed by a clamp, for instance by a key, to a batten beam. However it has been observed that at high weaving rates, i.e. of the order of 1,000 or more filling insertions per minute, that the reed dents may break in the vicinity of the lower U-channel profiled bar.

It is known to reinforce one or both ends of the reed with solid steel bars which are mounted between the upper and lower U-channels in relation to the reed dents and parallel to them. Such a reinforcing bar may be straight or be bent several times. When such a reinforcing bar is situated on the filling insertion side of the reed, difficulties are encountered in locating the main air jet nozzles and a cutter for the fillings, which should be located directly at the fabric selvage or at the reed. If such a reinforcing bar is mounted on the opposite reed side, then it will hamper the installation of a filling detector or of a filling stretcher, which also should be mounted directly at the fabric's side selvage or at the reed. In many cases this leads to a fabric having relatively wide waste edges. Moreover there may be streaks at the fabric edge in the zone of a solid-steel reinforcing bar. Regardless, at high weaving rates, such a reinforcing bar may fail to prevent the reed dents from breaking at the lower U-channel.

SUMMARY OF THE INVENTION

The objective of the invention is to create a device of the initially cited kind to substantially reduce the danger of the reed dents breaking.

This problem is solved in that the upper profiled bar of the reed is secured, at least in its end region, to the batten beam by a connecting brace element running substantially in the reed's longitudinal direction, against displacements in said longitudinal direction relative to the beam.

The invention offers the feature that the reed, in particular the upper profiled bar, and the reed dents shall not oscillate in the longitudinal direction of the reed. As a result the danger of reed dent rupture in the vicinity of the lower profiled bar already is substantially reduced.

In a further embodiment of the invention, the connection element shall be flexible transversely of the reed. Consequently the connection brace element will not restrict the reed dent deformation transversely to the reed's longitudinal direction at beat up against the fabric's edge, and thereby the reed dents are able to deform uniformly at beatup. This feature generally precludes fabric streaks. Also the danger of reed dent rupture in the vicinity of the lower profiled bar caused by beatup stresses is substantially reduced.

In a preferred embodiment, the connecting brace element is a metal blade affixed both to the upper profiled bar of the reed and at a distance from the end of the reed to the batten beam. In an advantageous design, the blade is made of steel and its thickness transversely to the reed is about 2 mm, its height parallel to the reed is about 15 mm and its length is approximately 100 to 200 mm. Such a blade will not bend at the stresses encountered, and longitudinal reed displacements are substantially prevented. Transverse displacements however are allowed and as a result the danger of forming streaks in the fabric is reduced.

In a further embodiment of the invention, a support holding the connecting brace element is mounted on the batten beam in a direction along an extension of the reed. As a result the connecting element is connected in simple manner to the batten beam while spaced from the reed. As regards an airjet loom, at least one main jet nozzle shall be mounted appropriately on this support. When the connecting element is mounted opposite the insertion side, then appropriately a filling detector and/or a filling stretcher shall be mounted on the said support. As a result, this support also can be used to mount operationally required components and the total number of additional parts is very low.

The invention also contemplates a method for bracing a reed against longitudinal movement at its upper end.

Further features and advantages of the invention will be evident from the description of the embodiments shown in the drawing and in the sub-claims.

DETAILED DESCRIPTION OF THE PREFERRED EMBODIMENTS

Figure 1:
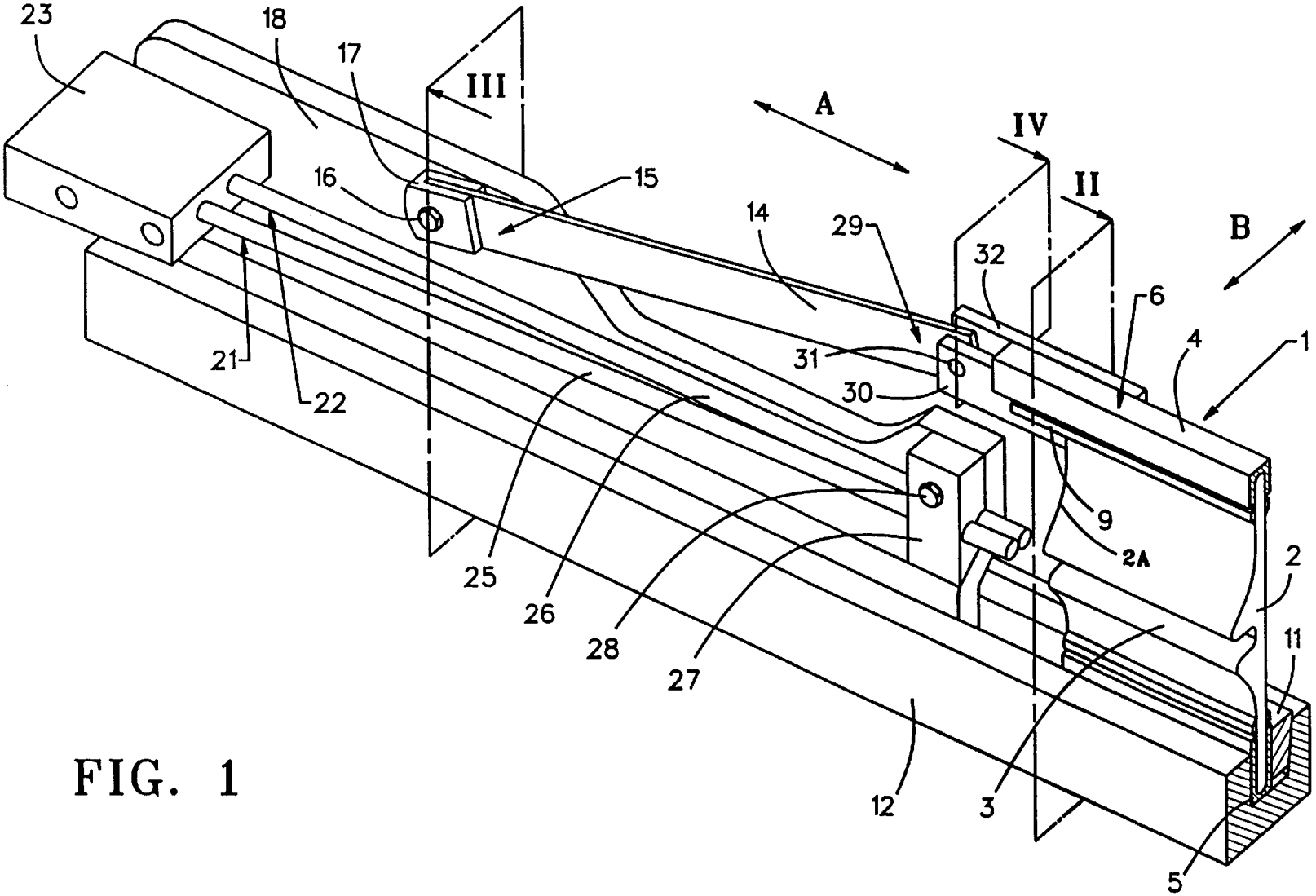
FIG. 1 is a perspective of a device of the invention to affix a reed to a batten beam.
Figure 2:
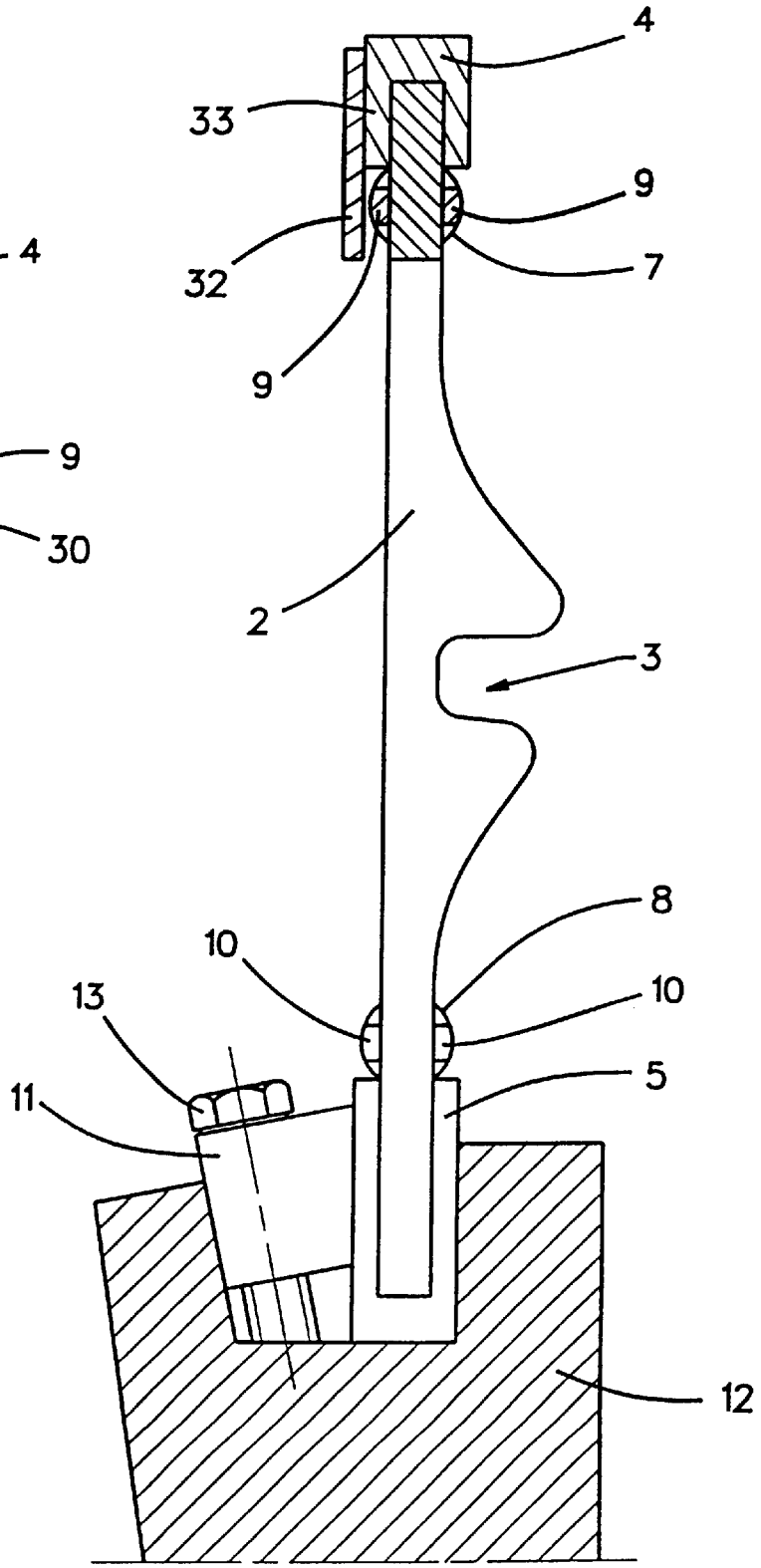
FIG. 2 is a section along the plane II of FIG. 1.

The reed 1 shown in FIGS. 1 and 2 is fitted with a plurality of sequentially mounted reed dents 2. A U-shaped recess is present approximately centrally in the reed dents 2 which together constitute a guide duct 3 for a filling. The reed dents 2 are affixed in a cross-sectionally profiled upper and a lower bar, namely in an upper U-channel 4 and in a lower U-channel 5. In both the upper U-channel 4 and in the lower U-channel 5, the reed dents 2 are kept apart from each other a predetermined distance by so-called connecting spirals 7, 8. Together with one connecting spiral 7 and 8 and retention bars 9 and 10, the reed dents 2 are bonded into the upper and lower U-channels 4 and 5 respectively. The lower U-channel 5 is affixed by a key 11 and screws 13 to a batten beam 12. The batten beam 12 is affixed in known manner by batten arms (not shown) to a batten shaft (not shown) extending parallel to the batten beam 12.

In addition, an elongated connecting blade or brace element 14 is mounted on the reed 1 and extends substantially in the longitudinal direction A of this reed 1 and because it is longitudinally inextensible and resists bending under longitudinal compression it prevents said reed from moving in said direction A relative to beam 12. In this embodiment the connecting blade 14 is mounted on the filling insertion side of the reed 1. The connecting blade 14 is made of steel for instance and its thickness in the transverse direction B is roughly 2 mm. Its height is about 15 mm. The connecting blade's length is about 100 to 200 mm.

The end 15 of the connecting blade 14 is connected to the batten beam 12 and is spaced from the reed 1. A fastener 17 is mounted on the end 15 and is affixed by a screw 16 to a support 18 which in turn is affixed to the batten beam 12. This connection is carried out in relation to the connection of the lower U-channel 5, that is using a key 19 and screws 20, as shown in FIGS. 1 and 3.

Figure 3:
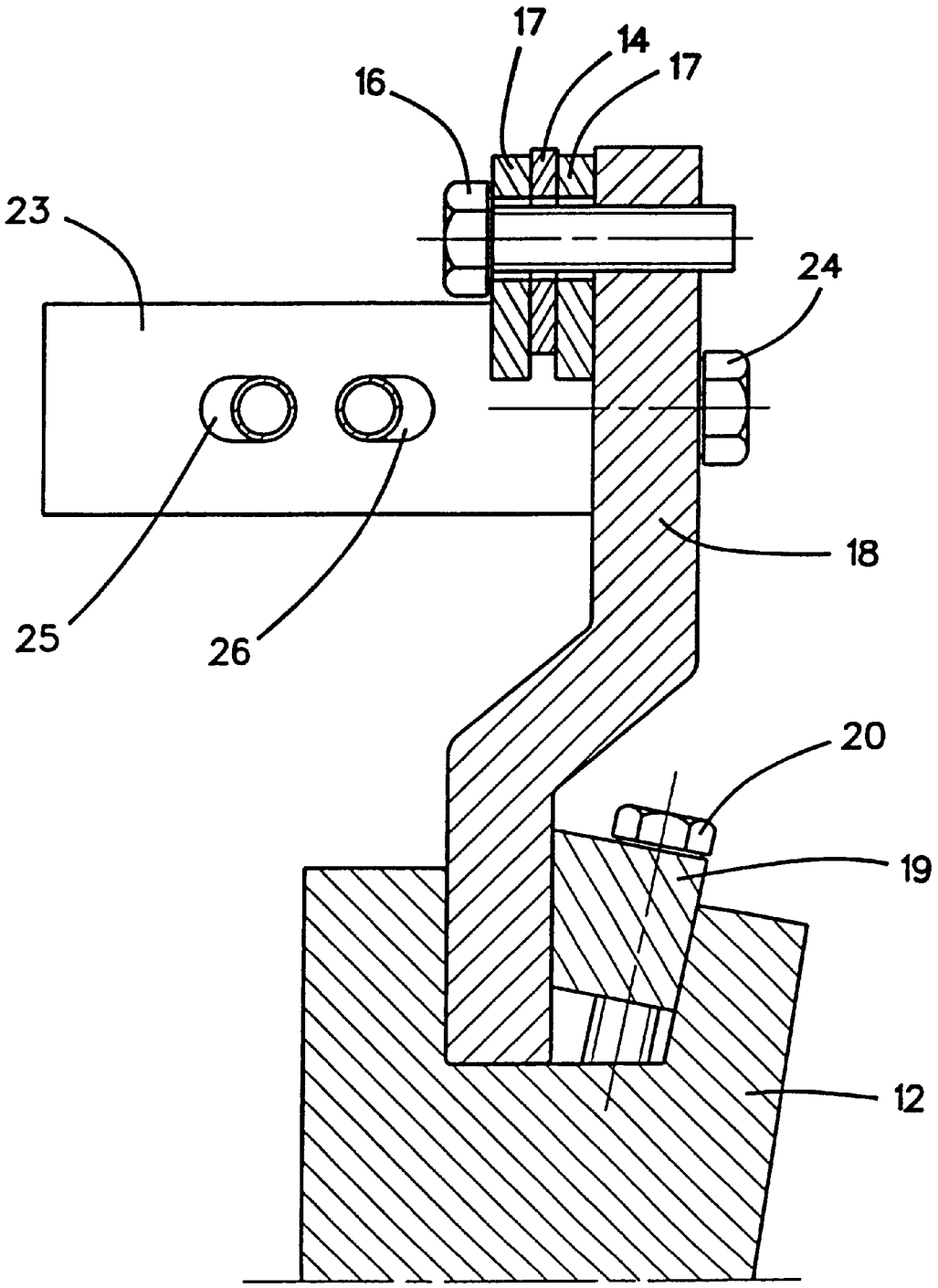
FIG. 3 is a section along plane III of FIG. 1.

The support 18 is formed in the shape of a bent metal plate which, in the case of an airjet loom, and as shown in FIGS. 1 and 3, also supports one or more main jet nozzles 21, 22. For that purpose a retention device 23 of the main airjet nozzles 21, 22 is fastened by screws 24 to the support 18. The ends of the jet tubes 25, 26 of the main airjet nozzles 21, 22 are also fastened by a further retention element or means 27 and a screw 28 to the support 18.

Figure 4:
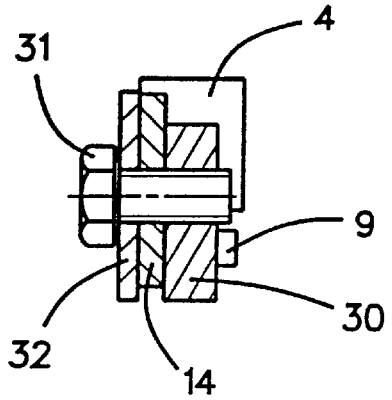
FIG. 4 is a section along plane IV of FIG. 1.

The end 29 of the connection blade 14 which is directed to the reed 1 is mounted to the upper U-channel 4 of said reed. For that purpose a strip 30 is inserted into that space between the section of the legs of the upper U-channel 4 which overhang and extend beyond the reed dents 2. The width of this strip 30 is about the same as the width of the upper zones of the dents 2 of the reed 1 which are bonded into the zone subtended between the legs of the upper U-channel 4. Accordingly the strip 30 can be housed in said leg space of the upper U-channel 4 similar to the reed dents 2. The strip 30 adjoins the first dent 2A of the reed 1 and the end of the connecting spiral 7. The retention bars 9 run over a given length beyond the first reed dent 2A and the end of the connecting spiral 7. Together with the retention bars 9, the strip 30 is bonded to the upper U-channel 4. Moreover the retention bars 9 may be welded onto the strip 30. A strong connection is required between the strip 30 and the upper U-channel 4 because it must absorb comparatively high stresses. The shown embodiment also includes a retention strip 32 which is bonded to the back side of the upper U-channel 4 of the reed 1. The connecting blade 14 is mounted between the strip 30 and the retention strip 32 and is affixed by a screw connector 31 that extends through suitable aligned connector receiving feature or apertures in blade 14 and strips 30,32 (see FIG. 4). Preferably the strip 30 is made of steel because such a selection is advantageous when affixing the connecting blade 14 using a screw 31. The thickness of the connecting blade 14 of this embodiment substantially corresponds to the thickness of the rear leg 33 (FIG. 2) of the upper U-channel 4. In this case, after the screw 31 has been tightened, the strip 30 and the retention strip 32 remain substantially mutually parallel. This design is especially appropriate for reeds wherein the upper U-channel 4 is made of aluminum or another relatively lightweight metal which per se would offer only modest mechanical strength.

In one embodiment variation, the connecting blade 14 is directly affixed by a screw to the upper U-channel 4 of the reed 1. This design is advantageous for instance when the upper U-channel 4 of the reed 1 is made of steel or another metal of comparatively high mechanical strength.

Figure 5:
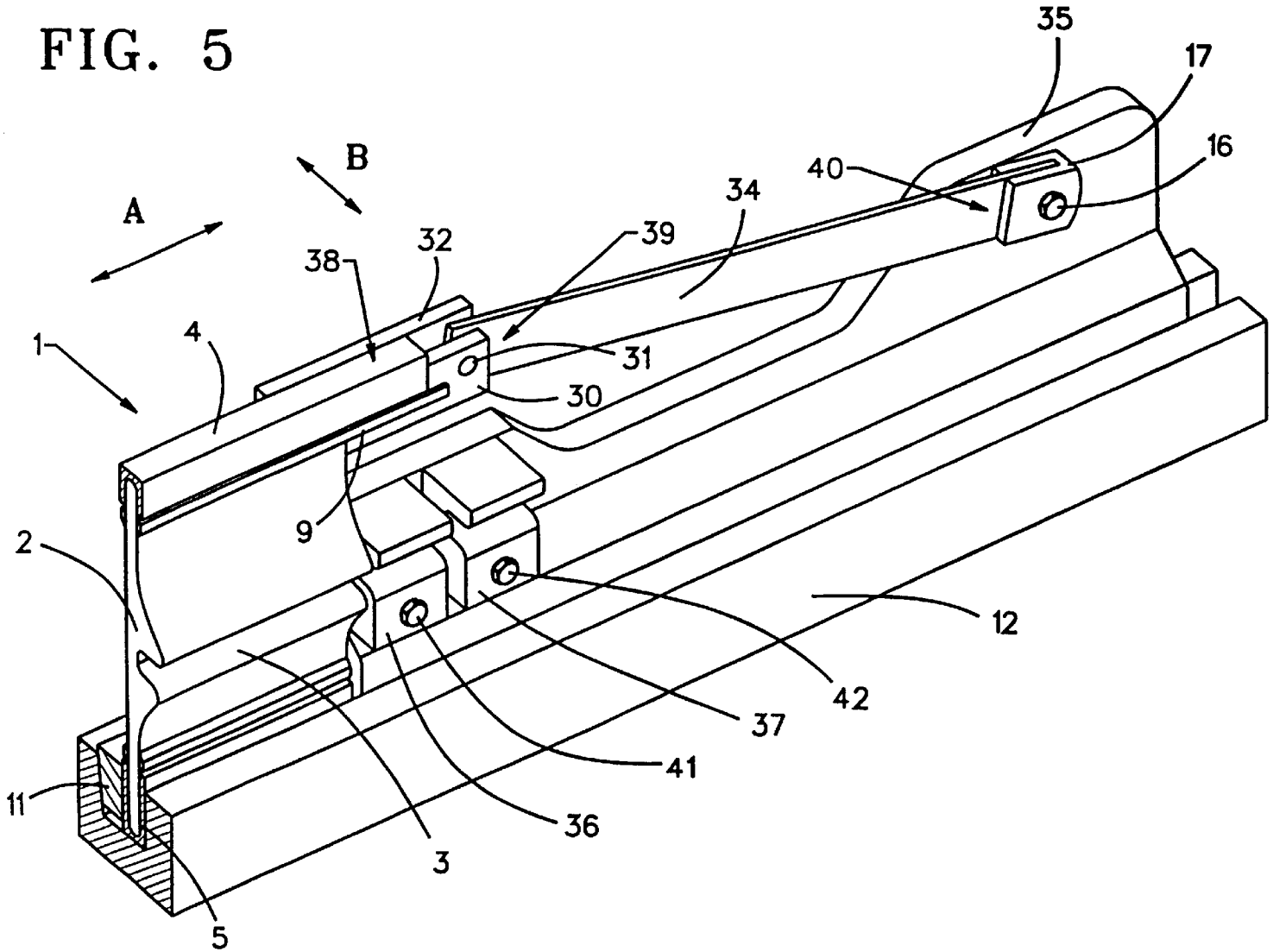
FIG. 5 is a perspective of another embodiment of a device of the invention.

FIG. 5 shows an embodiment which again offers the above described advantages, but wherein a connecting blade 34 is mounted on the opposite side of the reed 1, that is, at the side which is opposite the filling insertion side. The connecting blade 34 is connected in the manner of the embodiment of FIG. 1 by one end 39 to the upper U-channel 4 of the reed 1 and by its end 40 to a support 35. A filling detector 36 and/or a filling stretcher 37 is/are mounted on the support 35 which again is a bent metal plate and therefore are mounted directly next to the reed 1. The filling detector 36 and the stretcher 37 each are affixed by a screw 41 and 42 to the support 35.

In a further embodiment not shown, a connecting blade 14 is mounted at the filling insertion side of the reed 1 corresponding to FIG. 1 as well as a connecting blade 34 at the opposite side corresponding to FIG. 5.

By introducing one or both elongated connecting blades 14, 34, the reed 1 and in particular the upper U-channel 4 and the reed dents 2 shall be prevented from oscillating in the longitudinal direction A during weaving operation. The connecting blades 14 and/or 34 absorb both tensile and compressive forces, which prevent a displacement of the upper U-channel 4 toward the filling insertion side and in the opposite direction. The connecting blades 14 and 34 are dimensioned in such manner that they shall be strong enough not to bend when subjected to compression. Calculation shows that a connecting blade 14 or 34 about 2 mm thick and about 15 mm high is adequately resistant to bending when forces that arise at a weaving rate of 1,200 filling insertions a minute and with as many corresponding beatups.

The elongated connecting blades 14 and/or 34 at worst will slightly degrade the displacement in the transverse direction B of the end zone 6 of the reed 1 in the vicinity of the main airjet nozzles 21, 22 and/or of the end zone 38 of the reed 1 in the vicinity of the filling detector 36 or the stretcher 37. The displaceability of the reed 1 in these zones 6 and 38 is not restricted with respect to the middle zone. Such a feature is attained by the connecting blades 14 and/or 34 being comparatively long and consequently will not unduly oppose bending in the transverse direction B. As a result, any differential in the displaceability of the reed 1 in the transverse direction B is prevented that produces streaks or other irregularities in the vicinity of the selvages. On the other hand, because displacements and oscillations of the upper U-channel 4 are substantially suppressed in the longitudinal direction A, the dents 2 of the reed 1 are stressed less in the vicinity of the lower U-channel 5, and consequently the danger that the reed dents 2 should break in this region is considerably reduced.

The elongated connecting blade or brace elements 14 or 34 need not necessarily be in the shape of a blade or the like. Illustratively they may be in the form of round or polygonal bars of arbitrary cross-sections, which however should be designed in such a way that while substantially suppressing a displacement of the reed in the longitudinal direction A, they shall allow the displacement of the reed 1 in the transverse direction B. If called for, the connecting elements also may be wires, especially steel wires, or also plastic cords.

The invention is not restricted to the above described and illustrated embodiments. The scope of the invention is defined by the attached claims and allows changes and/or other combinations.

We claim:

1. In a reed assembly, wherein the reed includes upper and lower bars extending in a longitudinal direction of the reed said lower bar mountable on a batten beam, and reed dents extending between the upper and lower bars, the improvement comprising:

said upper bar including a means for connecting a brace element connectable to a batten beam to said upper bar, whereby the upper bar may be secured to a brace element affixed to a batten beam to be thereby braced against movement in the longitudinal direction of the reed.

2. The improvement as claimed in claim 1, wherein said means for connecting includes a section of said upper bar that overhangs and extends longitudinally beyond one side of said reed dents.

3. The improvement according to claim 1, wherein said means for connecting includes at least one strip secured rigidly to said upper bar, said strip extending in the longitudinal direction of the reed and away from the dents.

4. The improvement according to claim 2, wherein said means for connecting includes at least one strip secured rigidly.

5. The improvement according to claim 4, including an aperture in said strip extending in a direction extending transversely of the longitudinal direction of the reed.

6. The improvement according to claim 4, wherein said means for connecting includes a second strip secured rigidly to said section of said upper bar, said second strip extending parallel with said first strip and spaced from said first strip.

7. The improvement according to claim 6, including aligned apertures in said strips extending coaxially in a direction transversely of the longitudinal direction of the reed.

8. The improvement according to claim 7, wherein said reed dents and upper bar include a front side facing a fabric beat-up direction of the dents, and wherein said first strip is secured to a rear side of said upper bar opposite said front side.

9. The improvement according to claim 8, wherein said upper bar includes a channel configured and dimensioned to receive upper ends of said dents, said channel including an overhanging section disposed within said section of said upper bar that overhangs and extends longitudinally beyond one side of said dents, at least one portion of said second strip disposed in said overhanging section of said channel.

10. The improvement according to claim 6, wherein said upper bar and second strip are made of metal and are welded together.

11. The improvement according to claim 10, wherein said upper bar is aluminum and said second strip is steel.

12. The improvement according to claim 4, wherein said strip is bonded to said upper bar.

13. In a reed assembly, wherein the reed includes upper and lower bars extending in a longitudinal direction of the reed, said lower bar mountable on a batten beam, and reed dents extending between the upper and lower bars, the improvement comprising:

said upper bar including a connecting device connectable to a brace element connected to a batten beam, whereby the upper bar may be connected to a brace element affixed to a batten beam to be thereby braced against movement in the longitudinal direction of the reed.

14. The improvement according to claim 13, said connecting device including a connector receiving feature.

15. The improvement according to claim 13, said connecting device including a section of said upper bar that overhangs and extends longitudinally beyond one side of said reed dents.

16. The improvement according to claim 13, 14 or 15 wherein said connecting device includes at least one strip secured rigidly to said upper bar, said strip extending in the longitudinal direction of the reed and away from the dents.

17. The improvement according to claim 16, said connecting device including an aperture in said strip extending in a direction extending transversely of the longitudinal direction of the reed.

18. The improvement according to claim 16, wherein said reed dents and upper bar include a front side facing a fabric beat-up direction of the dents and wherein said at least one strip is bonded to a rear side of said upper bar opposite said front side.

19. The improvement according to claim 17, including a dent retention bar, wherein said strip is welded to said retention bar.

20. The improvement according to claim 15, said connecting device including at least one strip secured rigidly to said section of said upper bar that overhangs and extends beyond one side of said reed dents.

21. The improvement according to claim 15, wherein said connecting device includes a second strip secured rigidly to said upper bar, said second strip extending parallel with said first strip and spaced from said first strip.

22. The improvement according to claim 21, including aligned apertures in said strips extending coaxially in a direction extending transversely of the longitudinal direction of the reed.

23. The improvement according to claim 22, wherein said reed dents and upper bar include a front side facing a fabric beat-up direction of the dents, and said first strip is bonded to a rear side of said upper bar opposite said front side.

24. The improvement according to claim 20, wherein said upper bar includes a channel configured and dimensioned to receive upper ends of said dents, said channel including an overhanging section disposed within said section of said upper bar that overhangs and extends longitudinally beyond one side of said dents, at least one portion of said second strip disposed in said overhanging section of said channel.

25. The improvement according to claim 21, wherein said bar and said strip are made of metal and are welded together.

26. The improvement according to claim 25, wherein said bar is aluminum and said strip is steel.

27. A method of bracing a loom reed against motion in the longitudinal direction of the reed, said reed connected to a batten beam and including dents secured between upper and lower bars extending longitudinally along the reed, comprising:

connecting one end of an elongated brace element that extends generally parallel to the longitudinal direction of the reed and is substantially rigid along its longitudinal direction to. one end of said upper bar; and connecting an opposite end of the brace element to the batten beam;

said brace element dimensioned and configured to brace the upper bar against motion parallel to the longitudinal direction of the reed.

28. The method according to claim 27, including connecting said brace element to the upper bar by using at least one connecting strip extending longitudinally from one end of the reed, said brace connected to said upper bar via said strip.

29. The method according to claim 27, including using as a brace element an elongated metal bar that is longitudinally rigid but transversely bendable.

* * * * *